US005601047A

United States Patent [19]

Shen

[11] Patent Number: 5,601,047

[45] Date of Patent: Feb. 11, 1997

[54] DUALCAVITATING HYDROFOIL STRUCTURES FOR MULTI-SPEED APPLICATIONS

[75] Inventor: Young T. Shen, Potomac, Md.

[73] Assignee: The United States of America as represented by the Secretary of the Navy, Washington, D.C.

[21] Appl. No.: 668,662

[22] Filed: Jun. 25, 1996

Related U.S. Application Data

[63] Continuation-in-part of Ser. No. 414,836, Mar. 31, 1995, Pat. No. 5,551,369.

[51] Int. Cl.[6] ..... B63B 1/24

[52] U.S. Cl. ..... 114/274; 114/278

[58] Field of Search ..... 114/274–282; 244/207, 35 R, 35 Q; 416/223 R, 243, 231 B, 241 R

[56] References Cited

U.S. PATENT DOCUMENTS

| | | | |
|---|---|---|---|
| 3,065,723 | 11/1962 | Tulin | 114/66.5 |
| 3,077,173 | 2/1963 | Lang | 114/66.5 |
| 4,976,349 | 12/1990 | Adkins | 244/207 |
| 5,158,251 | 10/1992 | Taylor | 244/207 |

FOREIGN PATENT DOCUMENTS

| | | | |
|---|---|---|---|
| 2006413 | 1/1994 | U.S.S.R. | 114/278 |

OTHER PUBLICATIONS

Yim, B., "Finite Cavity Cascades With Low–Drag Pressure Distributions," Transactions of the American Society of Mechanical Engineers, vol. 95, No. 1, Mar. 1973, pp. 8–16.

Englar, Robert J., "Circulation Control For High Lift and Drag Generation on STOL Aircraft," Journal of Aircraft, vol. 12, No. 5, May 1975, pp. 457–463.

Englar, Robert J. and Robert M. Williams, "Design of a Circulation Control Stern Plane for Submarine Applications," Naval Ship Research and Development Center Report ASED–200 (Mar. 1971).

Lang, T. G., "Base–Vented Hydrofoils," U.S. Naval Ordnance Test Station Report 6606 (Oct. 1959).

*Primary Examiner*—Edwin L. Swinehart
*Attorney, Agent, or Firm*—Gary G. Borda

[57] ABSTRACT

A hydrofoil structures for efficient operation over a wide speed range from subcavitating to supercavitating operation is provided. The dualcavitating hydrofoil overcomes cavitation problems associated with high speed operation of prior art subcavitating hydrofoils by providing a supercavitating profile shape in the lower surface to achieve a supercavitating condition at high speeds, and overcomes performance related problems associated with low speed operation and structural problems associated with high speed operation of prior art supercavitating hydrofoils by providing a profile shape having a robust trailing edge that employs the Coanda effect to achieve a smooth flow exit at the trailing edge. The dualcavitating hydrofoil includes upper and lower surfaces defining a profile that includes a tapered section adjacent to and extending aft from the leading edge and a thick curved section adjacent to and extending forward of the trailing edge. The dualcavitating hydrofoil also includes boundary layer circulation control means for generating a flow over the trailing edge region such that boundary layer separation over the upper surface is avoided during normal subcavitating operation.

20 Claims, 5 Drawing Sheets

DUALCAVITATING HYDROFOIL STRUCTURES FOR MULTI-SPEED APPLICATIONS

STATEMENT OF GOVERNMENT RIGHTS

The invention described herein may be manufactured and used by or for the Government of the United States of America for governmental purposes without the payment of any royalties thereon or therefor.

CROSS REFERENCE TO RELATED APPLICATIONS

This application is a continuation-in-part of co-owned and application Ser. No. 08/414,836, filed Mar. 31, 1995, U.S. Pat. No. 5,551,369 and incorporated herein by reference.

BACKGROUND OF THE INVENTION

1. Field of Invention

The present invention relates generally to hydrofoil structures commonly employed to generate lift or thrust for marine applications such as for example, foils of high speed hydrofoil crafts, blades of marine propellers, and impellers of fluid pumps or turbines, where a lift force is produced by movement of the hydrofoil structure relative to the surrounding water. More particularly, the present invention relates to hydrofoil structures for efficient operation over a wide speed range from subcavitating to supercavitating operation and increased structural integrity in the trailing edge area.

2. Brief Description of Related Art

There is presently a great interest in providing high speed ships and ship propulsors capable of efficient operation at high speeds. Hydrofoil crafts have been used where operation above 45 knots is desired. The hydrodynamic characteristics of lift producing hydrofoil structures are very similar to the subsonic aerodynamic characteristics of aircraft wings. Thus, it has been possible to adapt many airfoil theories and computational techniques to hydrofoil and propeller blade section designs. However, there exists a major distinction between hydrofoil structures and aircraft wings. Operated below the free surface, a hydrofoil or propeller will develop vortex cavitation and surface cavitation on the foil or blade above a certain critical speed. Cavitation inception occurs when the local pressure falls to or below the vapor pressure of the surrounding fluid. Cavitation inception can be predicted from the pressure distribution over the hydrofoil structures since the cavitation inception index $\sigma_i$ is equal to the negative minimum pressure coefficient $-C_{Pmin}$. Above the critical cavitation inception speed, serious fundamental flow changes occur that lead to undesirable variations in hydrodynamic characteristics (e.g., loss of lift in hydrofoils and thrust breakdown in propellers) and possible damage to foil or blade structure. Thus, the major obstacle to achieving high sustained speeds in water is the occurrence of cavitation with its many detrimental effects. Consequently, the design philosophy for hydrofoil and propeller blade sections has been governed by the following requirements: (1) provide the required lift/thrust at a specified design point while ensuring adequate structural strength (especially at thin leading and trailing edges) for all operating conditions; and (2) avoid or minimize cavitation or the detrimental effects of cavitation. To this end, three distinct hydrofoil structures, i.e., subcavitating, basecavitating and supercavitating designs, have been proposed for use at different design speeds.

Subcavitating hydrofoil structures generally have conventional airfoil shaped profiles, i.e., streamlined cross-sectional shapes, and are designed to operate fully wetted over both the upper and lower surfaces. Such profiles derive most of their lift from their upper surfaces. Subcavitating hydrofoil structures operate efficiently, with high lift-to-drag ratios, at speed up to the critical speed at which the hydrofoil begins to experience cavitation, i.e., the critical cavitation inception speed. The critical cavitation inception speed may be increased through design methods such as varying the profile geometric characteristics, e.g., lowering the camber (to reduce hydrodynamic loading at the expense of efficiency) and/or reducing the section thickness (to reduce suction pressure $-C_{Pmin}$ at the expense of structural strength), or by restricting operation to lower sea states in order to reduce craft motions and maintain an angle of attack near the design angle. Typically, a subcavitating hydrofoil is efficient up to a critical speed of about 45 knots while a subcavitating propeller is efficient up to a critical speed of about 25 to 30 knots.

Due to the occurrence of cavitation, subcavitating hydrofoil structures are not practical for marine applications beyond the critical cavitation inception speed. To overcome the problems associated with cavitation on subcavitating hydrofoil structures, supercavitating hydrofoils and fully wetted basecavitating hydrofoils were developed in the 1960's for high speed marine applications.

Supercavitating hydrofoil structures are predominantly used at high speeds where subcavitating hydrofoil structures are impractical due to cavitation. Supercavitating hydrofoil structures generally have a triangular or wedge shaped profile with a sharp leading edge and a blunt trailing edge. Profile thickness typically increases from a minimum at the sharp leading edge to a maximum at the blunt trailing edge. The supercavitating condition is initiated at high speeds, i.e., supercavitating speeds, when the sharp leading edge causes formation of a fully developed cavity over the entire upper surface. Cavity collapse occurs well abaft of the trailing edge, thus, problems of buffeting and erosion associated with cavitation on subcavitating hydrofoil structures are avoided. To prevent cavitation, the lift producing lower surface of a supercavitating profile is generally flat or concave and is designed using well known supercavitating theory to produce operating pressures greater than ambient pressure. It is noted that NACA sections, which have been extensively used in subcavitating hydrofoil and marine propeller design, typically have convex lower surfaces that are not efficient lift producers under supercavitating conditions. Because supercavitating profiles derive their lift primarily from increased pressure over the lower surface, with the upper surface exerting no influence on lift production at supercavitating speeds, the lower surface shape is designed with little or no regards to the upper surface shape. The shape of the upper surface is immaterial as long as it does not contact the cavity wall, i.e., the free-surface between the air or vapor filled cavity and the water. Therefore, the upper surface is generally flat, although it may have a slight curvature in order to provide thickness for strength.

To achieve a supercavitating condition, a supercavitating hydrofoil or propeller must operate at high speeds and low cavitation numbers. At supercavitating speeds, the cavity generates a cavity drag that lowers efficiency. Moreover, due to extreme inefficiency prior to achieving supercavitating conditions, supercavitating hydrofoil structures are impractical for low speed operation, thus, necessitating secondary means of producing lift or thrust at low speeds. For example, for a supercavitating hydrofoil at a design speed of 60 knots and design lift coefficient ($C_L$) of 0.15, the required $C_L$ for takeoff at 25 knots is 0.86 (assuming a constant craft weight and foil planform area). To obtain such a high lift coefficient at takeoff speed the supercavitating hydrofoil must be operated at a very high angle of attack resulting in a large cavity drag. Generally, the drag will be so large that the craft will be unable to achieve takeoff unless an expensive high powered prime mover is installed.

In practical applications, a high speed hydrofoil craft may operate a substantial portion of time in the 30 to 45 knot range. Because of cavity drag associated with supercavitating profiles, the efficiency of supercavitating hydrofoils is significantly reduced at speeds below the design speed making them impractical and uneconomical for this speed range. To maintain a reasonable efficiency, the lower limit for application of supercavitating hydrofoils is approximately 50 knots while the lower limit for application of supercavitating propellers is approximately 45 to 50 knots. Below these speeds, only a partial cavity develops resulting in cavity collapse forward of the trailing edge causing buffeting and erosion. Additional obstacles associated with use of supercavitating hydrofoils include: the high angles of attack required to generate a reliable, steady cavity result in large drag and low efficiency, especially at off design speeds, when compared to subcavitating hydrofoils; due to increased form drag and decreased efficiency at low speeds, supercavitating hydrofoils have difficulty generating sufficient lift for take-off while supercavitating propellers have difficulty generating sufficient thrust to overcome a ship's hump drag; and due to the thin leading edge, difficulties arise in obtaining adequate structural strength.

Basecavitating hydrofoil structures (also referred to as base ventilated hydrofoils) have been proposed for use at design speeds falling in the intermediate range between subcavitating and supercavitating speeds. Basecavitating hydrofoil structures are similar in shape to supercavitating hydrofoils in that they generally have triangular or wedge shaped profiles with blunt trailing edges. Basecavitating hydrofoil structures, however, have thicker or blunter leading edges than supercavitating profiles to prevent formation of a cavity over the entire upper surface. The profile thickness increases from leading edge to trailing edge so that basecavitating hydrofoils can operate cavitation free at higher speeds than subcavitating profiles at the expense of increased form drag and lowers efficiency. To partially compensate for the increased form drag, base ventilated hydrofoil structures have a gas introduced into the flow behind the blunt trailing edge resulting in lower form drag than supercavitating profiles. However, efficiency at low speeds is less than subcavitating hydrofoils and, because basecavitating and base ventilated hydrofoil structures are designed to operated with the upper and lower surfaces fully wetted, lift force produced is sensitive to variations in angle of attack.

Subcavitating hydrofoils for low speed operation (typically less than about 45 knots), supercavitating hydrofoils for high speed operation (typically above about 50 to 60 knots) and basecavitating for intermediate speed operation have been known for some time. However, presently, there is no hydrofoil or propeller design capable of operating over a wide speed range, i.e., a speed range that encompasses subcavitating, basecavitating and supercavitating operating ranges, without experiencing the problems described above. Consequently, hydrofoils have generally been limited to efficient operation in only one of the subcavitating, basecavitating or the supercavitating regimes. Therefore, there is a need to provide a hydrofoil structure for use as a hydrofoil or marine propeller that overcomes the problems and operational limitation associated with subcavitating, basecavitating and supercavitating hydrofoils and propellers.

In co-owned and copending application Ser. No. 08/414,836, the present inventor has proposed a dualcavitating hydrofoil design, an example of which is presented in FIG. 1. As illustrated in FIG. 1, dualcavitating hydrofoil 10 includes upper surface 20, lower surface 22, leading edge 28 formed by the forward or upstream intersection of upper surface 20 and lower surface 22, and trailing edge 30 formed by the rearward or downstream intersection of upper surface 20 and lower surface 22. To generate adequate suction pressure on upper surface 20 during normal subcavitating operation and to minimize form drag during normal supercavitating operation, upper and lower surfaces, 20 and 22, are cooperatively designed to define a plurality of streamlined cross-sectional profiles 32 that satisfy the Kutta condition and achieves a smooth flow exit at trailing edge 30. Upper surface 20 is divided generally into two adjacent segments: forward upper segment 34 formed by the portion of upper surface 20 extending aft from leading edge 28 to upper junction 38; and aft upper segment 36 formed by the portion of upper surface 20 extending forward from trailing edge 30 to upper junction 38. Lower surface 22 is divided generally into two adjacent segments: forward lower segment **39*a* formed by the portion of lower surface 22 extending aft from leading edge 28 to lower junction 39*b*; and aft lower segment 39*c* formed by the portion of lower surface 22 extending forward from trailing edge 30 to lower junction 39*b*. Forward upper and forward lower segments, 34 and 39*a*, define forward section 42. Aft upper and aft lower segments, 36 and 39*c*, define aft section 44**.

Because of the need to satisfy pressure recovery requirements at aft section 44, aft upper segment 36 and aft lower segment **39*c* converge to a point at trailing edge 30** resulting in a thin trailing edge. In general, the hydrodynamic loading on a hydrofoil increases in proportion to the square of the speed. Furthermore, the hydrodynamic loading of an efficiently designed supercavitating hydrofoil is greater at the rear portion of the foil. Consequently, the presence of a thin trailing edge may require the use of exotic materials to satisfy the strength requirements and provided structural integrity at the trailing edge. Thus, there is a further need for a hydrofoil design that provides a more robust trailing edge design in a hydrofoil capable of operating over the subcavitating, basecavitating and supercavitating speed ranges.

SUMMARY OF THE INVENTION

Accordingly, it is an object of the present invention to provide a hydrofoil structure for operation over a wider speed range than known hydrofoils.

It is a further object of the present invention to provide a hydrofoil structure for multi-speed operation having a robust trailing edge for structural integrity.

It is a still further object of the present invention to provide a hydrofoil structure designed with dualcavitating characteristics capable of efficient operation at low speeds while in a subcavitating mode and at high speeds while in a supercavitating mode or a basecavitating mode (i.e., multi-speed operation).

Other objects and advantages of the present invention will become apparent to those skilled in the art upon a reading of the following detailed description taken in conjunction with the drawings and the claims supported thereby.

In a preferred embodiment of the present invention, a dualcavitating hydrofoil is provided that overcomes cavitation problems associated with high speed operation of prior art subcavitating hydrofoil structures by providing a supercavitating profile shape in the lower surface to achieve a supercavitating condition at high speeds. In this preferred embodiment, the dualcavitating hydrofoil overcomes performance related problems associated with low speed operation of prior art supercavitating hydrofoil structures and structural problems associated with high speed operation of prior art supercavitating hydrofoil structures by providing an upper surface that combines with the lower surface to form a cross-sectional shape having a thick, robust, curved trailing edge and that employs the Coanda effect to achieve a smooth flow exit at the trailing edge for efficient, low drag, high lift subcavitating operation.

In accordance with the present embodiment, a dualcavitating hydrofoil for providing dynamic lift sufficient to lift a marine vehicle above a water surface is provided. The dualcavitating hydrofoil of the present invention includes an upper surface, a lower surface, a leading edge formed by a forward or upstream intersection of the upper and lower surfaces, and a trailing edge. The upper and lower surfaces defining the profile of the dualcavitating hydrofoil. The profile includes a tapered section adjacent to and extending aft from the leading edge. The leading edge is thin, that is the tapered section may taper to a sharp wedge or a thin rounded profile. The profile further includes a thick curved section adjacent to and extending forward of the trailing edge. Thus, the profile adjacent the trailing edge is thick when compared to the thin leading edge profile. The dualcavitating hydrofoil also includes boundary layer circulation control means for generating a flow over the aft upper segment such that boundary layer separation over the upper surface is avoided during normal subcavitating operation.

The upper and lower surfaces extend between first and second lateral ends. The upper surface is adapted to efficiently produce the lift force during normal subcavitating operation at subcavitating speeds wherein the upper and lower surfaces are substantially fully wetted. The lower surface is adapted to efficiently produce the lift force during normal supercavitating operation at supercavitating speeds wherein the upper surface is enveloped within an air or vapor filled cavity generated by the lower surface and the lower surface is substantially fully wetted. The cavity has a cavity streamline defined by the outer edge of the cavity, i.e., the interface between the air or vapor filled cavity and the surrounding water.

The lower surface constitutes a supercavitating profile having a concave curvature in at least the aft lower segment. During normal supercavitating operation the lower surface functions to generate a fully developed cavity extending aft from the leading edge such that during normal supercavitating operation the upper surface is completely enveloped within the cavity. The cavity has a cavity streamline defined by an outer edge of the cavity associated therewith.

The upper surface is divided into a forward upper segment and an aft upper segment and includes an upper junction therebetween. The forward upper segment extends aft from the leading edge. The forward upper segment joins the aft upper segment at the upper junction. The contour of the forward upper segment corresponds to the cavity streamline determined at an angle of $(\alpha-x\Delta\alpha)$ where e is a design angle of attack of the dualcavitating hydrofoil during normal supercavitating operation, $\Delta\alpha$ is a predetermined operational variation of the design angle of attack experienced by the dualcavitating hydrofoil during normal supercavitating operation, and x is a parameter between 1.0 and 1.4. The contour of the aft upper segment is adapted to provide the thick curved section at the trailing edge.

In an alternative embodiment, a dualcavitating hydrofoil is provided that overcomes cavitation problems associated with high speed operation of prior art subcavitating hydrofoil structures by providing a basecavitating profile shape to achieve a basecavitating condition at high speeds, and that overcomes problems associated with low speed operation of prior art basecavitating and base ventilated hydrofoil structures by providing an upper surface that combines with the lower surface to form a cross-sectional shape having a thick, robust, curved trailing edge and that employs the Coanda effect to achieve a smooth flow exit at the trailing edge for efficient, low drag, high lift subcavitating operation.

In accordance with the present embodiment, a dualcavitating hydrofoil comprises an upper surface, a lower surface, a leading edge formed by a forward intersection of the upper and lower surfaces, and a trailing edge. The upper surface is divided into a forward upper segment extending aft from the leading edge, an aft upper segment, and an upper junction therebetween. The forward upper segment joins the aft upper segment at the upper junction and the lower surface joins the aft upper segment at a lower junction. The upper and lower surfaces define the profile of the dualcavitating hydrofoil. Forward of a plane connecting the upper and lower junctions the profile is tapered to a thin leading edge while aft of this plane the profile has a curved trailing edge that is thick when compared to the thin leading edge. The dualcavitating hydrofoil further includes a boundary layer circulation control means for generating a flow over the aft upper segment such that boundary layer separation over the upper surface is avoided during normal subcavitating operation.

The upper and lower surfaces function to provide a lift force sufficient to lift the marine vehicle above the water surface. The upper and lower surfaces are adapted to efficiently produce the lift force during normal subcavitating operation at subcavitating speeds wherein the upper and lower surfaces are substantially fully wetted. The upper and lower surfaces are adapted to efficiently produce the lift force at speeds above the normal subcavitating speeds wherein the upper and lower surfaces are substantially fully wetted forward of about the upper and lower junctions and the aft upper section is completely enveloped within a cavity initiating from about the upper and lower junctions.

BRIEF DESCRIPTION OF THE DRAWINGS

The foregoing objects and other advantages of the present invention will be more fully understood by reference to the following description taken in conjunction with the accompanying drawings wherein like reference numerals refer to like or corresponding element throughout and wherein.

DETAILED DESCRIPTION OF THE PREFERRED EMBODIMENT

Figure 1:
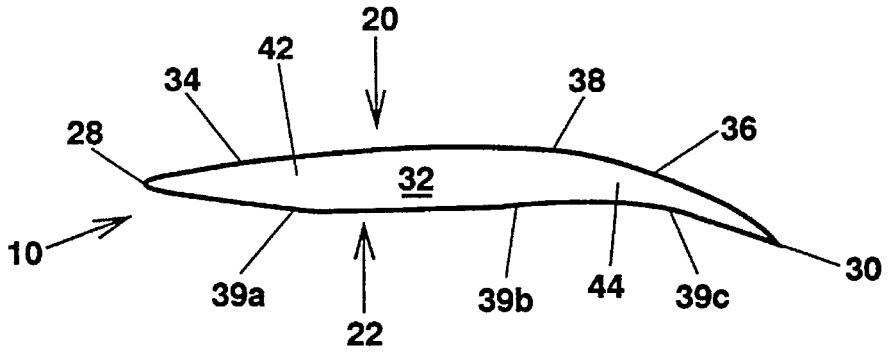
FIG. 1 shows an exemplary embodiment of the invention as disclosed in co-owned and copending application Ser. No. 08/414,836.

Referring now to the drawings, and particularly to FIGS. 2–9, dualcavitating hydrofoil 10 of the present invention is a new class of hydrofoil structure that can be operated efficiently in a subcavitating condition at low speeds (below about 45 knots), a basecavitating (or base ventilated) condition at intermediate speeds (between about 45 and 60 knots), and a supercavitating condition at high speeds (above about 45 to 50 knots). As represented in FIGS. 2A and 2B, dualcavitating hydrofoil 10 is installed on hydrofoil craft marine vehicle 12 by means of struts 14. Dualcavitating hydrofoil 10 may be mounted to struts 14 of marine vehicle 12 in any well known manner and the method of mounting is not intended as a limitation on the present invention. The type and size of marine vehicle 12 with which dualcavitating hydrofoil 10 is used is not intended to be a limitation on the present invention. Dualcavitating hydrofoil 10 may be constructed of any material suitable for use in a marine environment that provides adequate strength properties, such as for example, metal, metal composites, and non-metal composites such as fiber reinforced resin or plastic composites.

Figure 2A:
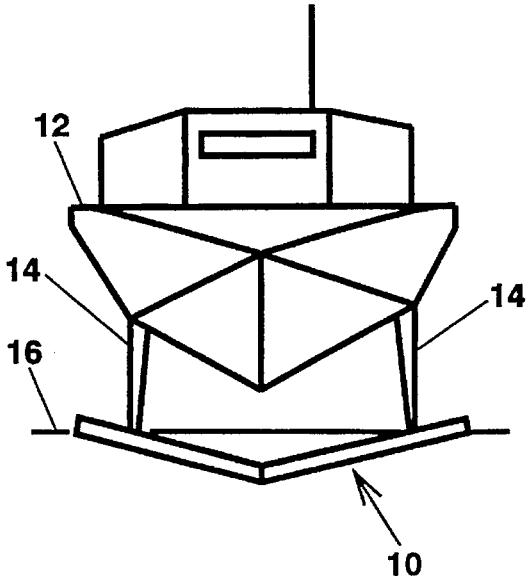
FIGS. 2A and 2B show surface piercing hydrofoil and fully submerged hydrofoil arrangements, respectively.
Figure 2B:
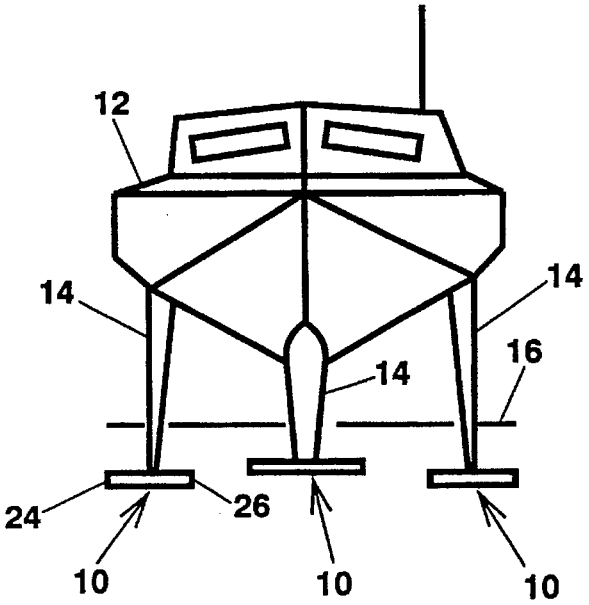

Many different hydrofoil craft configurations are possible, although typically there must be lifting surfaces forward and aft for longitudinal stability. Two basic types of prior art hydrofoil crafts 12 based on the hydrofoil lifting surface configuration are shown in FIGS. 2A and 2B. FIG. 2A illustrates a surface piercing hydrofoil arrangement while FIG. 2B present a fully submerged hydrofoil arrangement. Surface piercing hydrofoils are characterized by inherent static and dynamic stability in pitch, roll, yaw and heave through area stabilization. A deviation from the equilibrium position causes a change in the lift-producing wetted area which creates restoring forces and moments. Stability of fully submerged hydrofoils is generally maintained through lift modulation (modification of lift force in relation to craft position) by way of incidence control (controlling the hydrofoil angle of attack or the craft trim) or active trailing edge flaps. Methods of lift modulation, which are well known in the art, may be used with the present invention. However, the present invention makes it possible to dispense with the need for such expensive and complicated active lift augmenting devices by employing a boundary layer circulation control means that generates a Coanda flow over the trailing edge region of dualcavitating hydrofoil 10 to control circulation for lift augmentation.

A hydrofoil craft has two modes of operation: the slow-speed hullborne mode and, with increasing speed through the take-off, the flying or foilborne mode. At hullborne mode the craft behaves like a planing hull with its characteristic hump resistance. Take-off may occur at speeds near the maximum hullborne drag (hump speed) with subsequent acceleration to design speed (cruise speed), which may be two or more times the take-off speed. In the foilborne mode, the effective lift-to-drag ration (L/D) must be adequate for the intended operation of the hydrofoil craft. That is, dualcavitating hydrofoil 10 must generate sufficient dynamic lift to achieve take-off and to maintain foilborne operation at its design speed in its particular operating environment. Operating environment generally refers to (a) anticipated seaway seen by dualcavitating hydrofoil 10 (sea-states environment at its projected operational locale), and (b) whether dualcavitating hydrofoil 10 is operating in a subcavitating, basecavitating or supercavitating mode.

Water flowing over a hydrofoil lifting surface generates a pressure differential between the upper and lower surfaces of the foil resulting in a lift force. The lift force produced varies with the foil's angle of attack (angle of foil chord relative to the incoming undisturbed free stream flow) and the incoming flow velocity (velocity of foil relative to the undisturbed free stream flow into the foil). In order to achieve take-off and foilborne operation, the lift produced by dualcavitating hydrofoil 10 must equal the weight of marine vehicle 12, i.e., $$W=L=(\partial C_l/\partial\alpha)\alpha(\rho V^2/2)A \quad (1)$$

where W, L, $(\partial C_L/\partial\alpha)$, $\alpha$, $\rho$, V and A are the vehicle weight, hydrofoil lift, lift-curve slope, hydrofoil angle of attack, water density, vehicle speed, and hydrofoil wetted area, respectively. The theoretical lift-curve slope is equal to $2\pi$ for the subcavitating flow condition, is equal to $\pi/2$ for the supercavitating flow condition, and is between those two values for basecavitating/base ventilated operation.

Generally, once the size, weight, and intended operational envelope of marine vehicle 12 are known, the designer can determine the span, operating depth and configuration of dualcavitating hydrofoil 10. Based on equation (1), dualcavitating hydrofoil 10 generates the required lift to achieve take-off and to maintains low drag (high L/D) foilborne operation at subcavitating, basecavitating, and supercavitating speeds by using the difference in lift-curve slope and foil wetted surface area among subcavitating, basecavitating, and supercavitating operation, and by employing boundary layer circulation control means 46 (described below).

Dualcavitating hydrofoil 10 provides the dynamic lift force necessary to lift marine vehicle 12 above water surface 16. As shown in FIGS. 2–4 and 7–9, dualcavitating hydrofoil 10 includes upper surface 20 and lower surface 22. Upper and lower surfaces, 20 and 22, extend between first and second lateral ends, 24 and 26. Dualcavitating hydrofoil 10 further includes leading edge 28 formed by the forward or upstream intersection of upper surface 20 and slower surface 22, and trailing edge 30. The span of dualcavitating hydrofoil 10 is defined as the straight line distance between first and second lateral ends, 24 and 26. The straight line distance between leading edge 28 and trailing edge 30 defines the chord. Herein, the plane of dualcavitating hydrofoil 10 is defined as the plane passing through leading edge 28 and trailing edge 30.

The orientation of dualcavitating hydrofoil 10 with respect to the undisturbed free stream is known as the angle of attack $\alpha$. Thus, the angle of attack of dualcavitating hydrofoil 10 is the angle between the plane of dualcavitating hydrofoil 10 and the free stream velocity vector (direction of the free stream into dualcavitating hydrofoil 10). The design angle of attack during subcavitating and supercavitating operation are not necessarily the same. Therefore, the angle of attack of dualcavitating hydrofoil 10 may be varied during the different operational modes using well known incidence control devices to vary the actual orientation of dualcavitating hydrofoil 10 or by modifying the trim of marine vehicle 12.

Herein, in the specification and claims, the terms "normal subcavitating operation" and "normal supercavitating operation" and variations thereof, are used and will now be defined. Dualcavitating hydrofoil 10 is designed to produce lift sufficient to achieve take-off and to maintain foilborne operation at a particular design speed and design angle of attack. Moreover, dualcavitating hydrofoil 10 will generate this lift over a known range of operation in terms of angle of attack and speed. Hydrofoil craft are typically designed to operate in both calm water and a seaway. In a seaway, the lifting surfaces of a hydrofoil craft experience changes in angle of attack due to both water orbital motion and craft motion. Thus, during normal operations, dualcavitating hydrofoil 10 will experience small to moderate angle of attack variations. The variation in angle of attack can be determined by an experienced hydrofoil designer based on his or her experience and knowledge of the craft's operational speed range and sea states experience at the craft's intended operational location.

"Normal subcavitating operation" refers to operation at subcavitating speeds (generally between about take-off speed and about 45 knots) at operational angles of attack equal to ($\alpha_{SUB}\pm\Delta\alpha_{SUB}$) where $\alpha_{SUB}$ is the subcavitating design angle of attack of dualcavitating hydrofoil 10 and $\Delta\alpha_{SUB}$ is a predetermined operational variation of the design angle of attack experienced over the subcavitating speed range of interest. During "normal subcavitating operation" both upper surface 20 and lower surface 22 are substantially fully wetted and upper surface 20 produces substantially all of the dynamic lift by generating a low pressure region over upper surface 20.

"Normal supercavitating operation" refers to operation at supercavitating speeds (generally above about 45 to 50 knots) at operational angles of attack equal to ($\alpha_{SUPER}\pm\Delta\alpha_{SUPER}$) where $\alpha_{SUPER}$ is the supercavitating design angle of attack of dualcavitating hydrofoil 10 and $\Delta\alpha_{SUPER}$ is a predetermined operational variation of the design angle of attack experienced over the supercavitating speed range of interest. During "normal supercavitating operation" upper surface 20 is completely enveloped within cavity 50 while lower surface 22 is substantially fully wetted and lower surface 22 produces substantially all of the dynamic lift by generating a high pressure region over lower surface 22.

As stated earlier, dualcavitating hydrofoil 10 includes upper surface 20, lower surface 22, leading edge 28 formed by a forward or upstream intersection of upper surface 20 and lower surface 22, and trailing edge 30. Upper surface 20 and lower surface 22 define profiles 32 of dualcavitating hydrofoil 10. Cross-sectional profiles 32 are spaced in the spanwise direction between first and second lateral ends, 24 and 26. Each profile 32 extends in the chordwise direction between leading edge 28 and trailing edge 30. Thus, profiles 32 are cross-sectional cuts perpendicular to the foil span residing in parallel planes perpendicular to the foil span and to the plane of dualcavitating hydrofoil 10.

Upper surface 20 is divided generally into two adjacent segments: forward upper segment 34 formed by a portion of upper surface 20 extending aft from leading edge 28; and aft upper segment 36. The aft end of forward upper segment 34 joins the forward end of aft upper segment 36 at upper junction 38 to provide a continuous upper surface 20. Lower surface 22 joins the terminal end of aft upper segment 36 at lower junction 40. Dualcavitating hydrofoil 10 also includes boundary layer circulation control means 46 for generating a Coanda flow over aft upper segment 36 such that boundary layer separation over upper surface 20 is avoided during normal subcavitating operation.

As more fully described below, generally, the shape of lower surface 22 is first determined (e.g.,supercavitating profile to provided required lift), the shape of forward upper segment 34 is then determined (e.g., corresponding to cavity streamline), the shape of aft upper segment 36 is then designed to merge with forward upper segment 34 at upper junction 38 and with lower surface 22 at lower junction 40. Generally, for ease of manufacture, upper junction 38 and lower junction 40 are approximately aligned across the thickness of profile 32. That is, a straight line connecting upper junction 38 and lower junction 40 will be approximately perpendicular to a straight line connecting leading edge 28 and trailing edge 30. Preferably, upper junction 38 is located at a point just upstream of the initial point where flow would separate from upper surface 20 if circulation control means 46 were not employed to prevent separation during normal subcavitating operation. The location of this separation point is determined at a predetermined subcavitating speed and subcavitating design angle of attack during normal subcavitating operation. Methods of determining flow separation are well known in the art and will not be discussed in detail herein. Normally, the separation point is located at or near the initiation point of the adverse pressure gradient over upper surface 20. With the guidance provided herein, one skilled in the art of propeller/hydrofoil/airfoil design could advantageously locate upper junction 38 such that flow remains attached to upper surface 20 as long as possible without applying the Coanda effect.

Profiles 32 includes tapered forward section 42 adjacent to and extending aft from leading edge 28 and curved aft section 44 adjacent to and extending forward from trailing edge 30. Preferably, leading edge 28 is thin and profile 32 has its maximum thickness located within or contiguous with aft section 44. Consequently, the profile of aft section 44 adjacent to trailing edge 30 is thick when compared to the profile of forward section 42 adjacent to leading edge 28. Depending on structural strength requirements, forward section 42 may taper to a sharp wedge profile or to a thin rounded nose profile. If leading edge 28 takes the form of a rounded nose, the shape is preferably obtained using the point-drag singularity method developed for supercavitating hydrofoil theory and reported in: Yim, B., "Finite Cavity Cascades With Low-Drag Pressure Distribution," Transactions of the American Society of Mechanical Engineers, Vol. 95, No. 1, Mar. 1973, pp. 8–16, incorporated herein by reference.

Figure 6A:
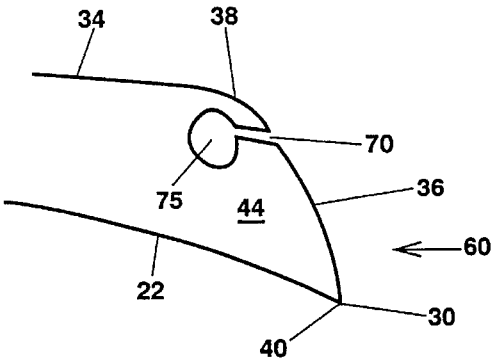
FIGS. 6A, 6B and 6C show alternative trailing edge designs used with the present invention.
Figure 6B:
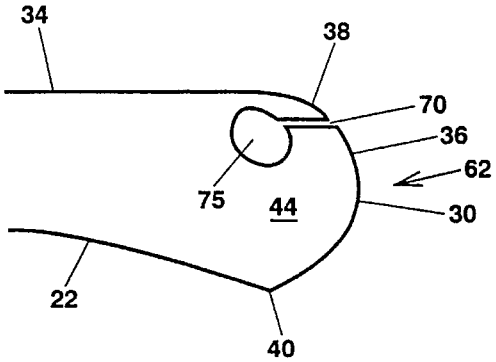
Figure 6C:
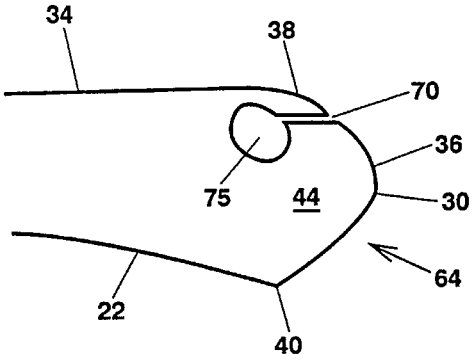

The contour of aft upper segment 36 is adapted to provide a thick, robust trailing edge for structural integrity. As shown in FIG. 6A, aft upper segment 36 may take the form of jet flap 60 wherein trailing edge 30 is formed by an aft intersection of upper surface 20 and lower surface 22. Jet flaps (also know as jet sheets) are shaped such that the minimum flow rate from circulation control means 46 is required for attached flow. Jet flap profiles are known and have been used in aerodynamics (e.g., as trailing edge profiles for helicopter blades employing Coanda flow at the trailing edge) and will not be described in detail herein. When employing jet flap 40, upper junction 38 will be located just upstream of the calculated subcavitating separation point and lower junction 40 will coincide to the aft end of lower surface 22 (i.e., trailing edge 30 corresponds to lower junction 40). Alternatively, aft upper segment 36 may take the form of a bluff body. Examples of bluff bodies within the scope of the present invention include circular arc 62 (FIG. 6B) and elliptical arc 64 (FIG. 6C). Elliptical arc 64 may advantageously comprises a portion of an ellipse having a ratio of its major to minor axes of about 2 to 1, wherein the portion of the ellipse is taken along the minor axis, i.e., a cut being made parallel to the minor axis. When aft upper segment 36 takes the form of a bluff body, trailing edge 30 is formed by the aft most extension of aft upper segment 36 and lower junction 40 is located forward or upstream of trailing edge 30. As pictured in FIGS. 6B and 6C, lower junction 40 will be approximately aligned with upper junction 38 and will define the plane of maximum cross-sectional thickness of dualcavitating hydrofoil 10.

Starting at the stagnation point, during normal subcavitating operation, flow over dualcavitating hydrofoil 10 is accelerated in the chordwise direction. The local velocity is V and the free stream velocity relative to dualcavitating hydrofoil 10 is $V_{28}$. At certain locations along upper surface 20, this leads to $V/V_{28}>1$, with local pressure falling below that of the surrounding fluid. Normally, to prevent flow separation over upper surface 20, the dynamic pressure in the vicinity of the trailing edge must be lowered to values corresponding to $V/V_{28}<1$. This region of flow is called the pressure recovery region.

Generally, in the embodiments of the invention described in co-owned and copending application Ser. No. 08/414,836, to produce an efficient hydrofoil over a speed range encompassing both subcavitating and supercavitating speeds, upper and lower surfaces, 20 and 22, are design as an integral unit using well known supercavitating theory originated by Tulin and Burkart and section profile design theory originated by Eppler. The pressure distribution and flow characteristics of an airfoil or hydrofoil can be determined using any of a number of well known computer programs for computing airfoil or hydrofoil performance and predicting free-field velocity/pressure distributions. Once the supercavitating profile of lower surface 22 is specified, the shape of cavity 50 at the design speed and design cavitation number is fixed, thus defining the shape of and pressure distribution over forward upper segment 34. Using the section profile design theory, the contour of aft upper segment 36 is adapted to provide a complete pressure recovery over upper surface 20 such that boundary layer separation over upper surface 20 is avoided during normal subcavitating operation. Because of the need to satisfy pressure recovery requirements at the aft portion of the dualcavitating hydrofoil 10, the aft upper and aft lower segments, 36 and 39*c*, converge to a point at trailing edge 30 resulting in a thin trailing edge (FIG. 1). Moreover, an efficiently designed supercavitating hydrofoil is more heavily loaded hydrodynamically at the rear portion of the foil. Consequently, the presence of a thin trailing edge may require the use of expensive high-strength materials to provided structural integrity at the trailing edge.

However, the present embodiments of dualcavitating hydrofoil 10 provide a more robust trailing edge 30 for dualcavitating hydrofoil 10 while maintaining the capability of operating efficiently over the subcavitating, basecavitating and supercavitating speed ranges. The contour of aft upper segment 36 is adapted to provide thick, curved aft section 44. Because of the thick trailing edge 30, pressure recovery over upper surface 20 is not complete and, left alone, the flow will separate resulting in increased form drag and reduced hydrofoil efficiency. To prevent flow separation over upper surface 20, the present invention employs boundary layer circulation control means 46 to suppress flow separation during normal subcavitating operation. Air blowing to control the boundary layer circulation has been used in aerodynamic applications such as helicopters and short takeoff and landing (STOL) aircraft.

The basic circulation control concept involves the well known Coanda principle where a thin jet of air remains attached to an airfoil's rounded trailing edge due to the balance between centrifugal force and the pressure differential produced by the jet velocity. Application of tangential blowing over a round Coanda surface is presented in: Englar, Robert J., "Circulation Control for High Lift and Drag Generation on STOL Aircraft," Journal of Aircraft, Vol. 12, No. 5, May 1975, pp. 457–463, incorporated herein by reference. It has been documented in aerodynamics that to adequately suppress flow separation, only a small amount of air blowing into the boundary layer is required. When separation is suppressed and flow remains attached, form drag is reduced and efficiency is increased. Further increase in the rate of tangential blowing can produce very high lift with lift coefficients as high as 8. Thus, circulation control means 46 may be used further for lift augmentation, replacing methods of lift modulation such as incidence control or active trailing edge flaps used on present hydrofoil crafts.

Figure 9:
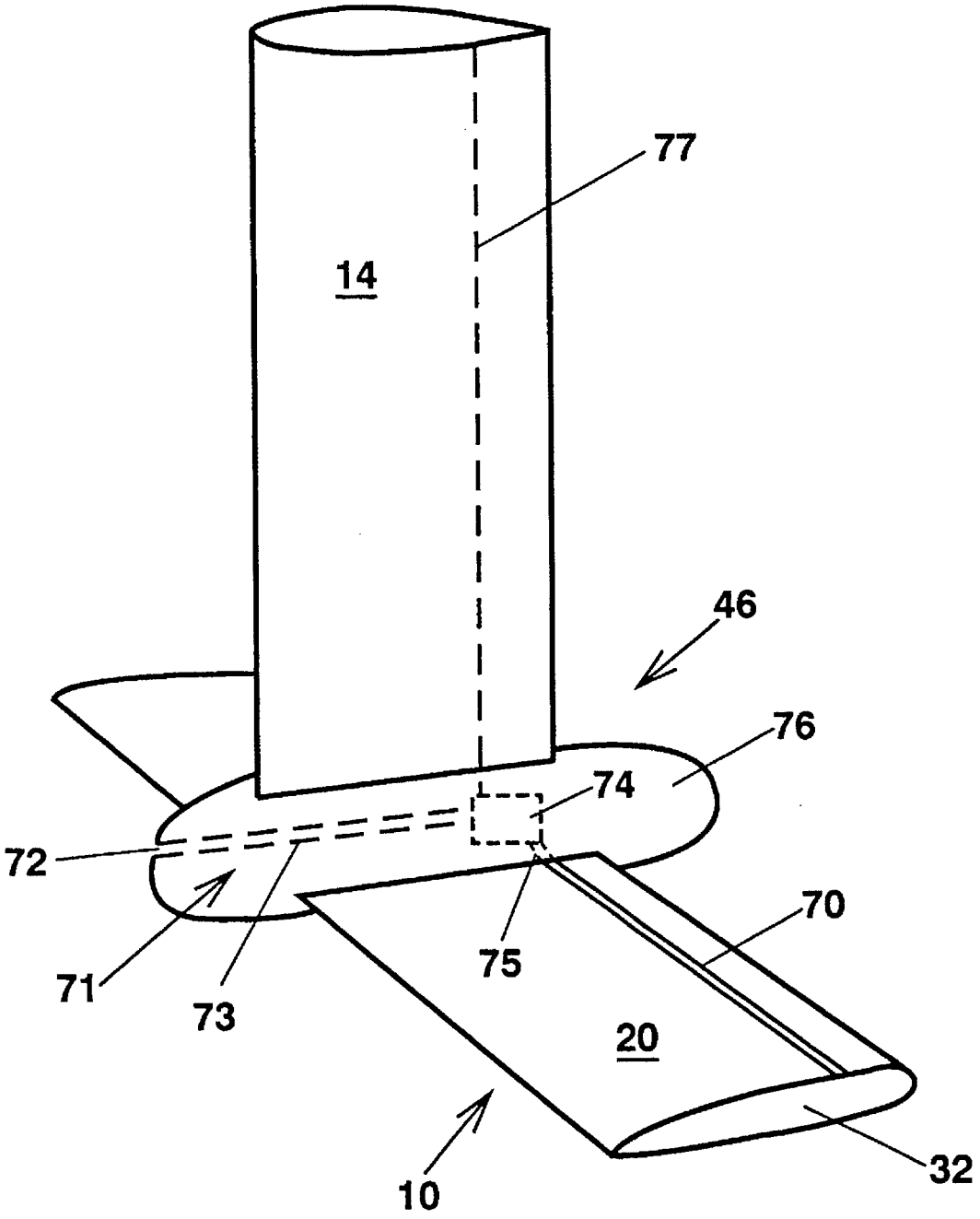
FIG. 9 presents an exemplary embodiment of the present invention showing a boundary layer circulation control system.

As demonstrated in FIG. 9, circulation control means 46 includes blowing slot 70 in upper surface 20 and means 71 for delivering a pressurized flow to blowing slot 70. Blowing slot 70 generally extends laterally over upper surface 20 and is located adjacent upper junction 38. Blowing slot 70 functions to eject flow in an aft or downstream direction and tangentially to aft upper segment 36. Means 71 for delivering flow to blowing slot 70 includes flow inlet 72 in flow communication with blowing slot 70 by means of inlet conduit 73, pump means 74, and delivery conduit or plenum 75. Herein, when two elements are said to be in "flow communication" they are interconnected so as to be in flow communication by, for example, such well known interconnecting means as ducts, conduits, pipes, tubes, hoses, or any other suitable means for transporting a fluid under pressure. As shown in FIG. 9, dualcavitating hydrofoil 10 may be mounted to strut 14 by way of central pod 76. In such a configuration, inlet 72, inlet conduit 73 and pump means 74 may be located in pod 76 with power being delivered to pump means 74 by power mean (not shown) by way of power cable 77. However, pod 76 is not required by the present invention and inlet 72 may be located at the leading edge of hydrofoil 10 or strut 14 or flow may be provided from a source other than inlet 72. Additionally, pump means 74 may be located internal to hydrofoil 10, to strut 14 or to marine vehicle 12. Generally, circulation control means 46 is operational during normal subcavitating operation to prevent flow separation over upper surface 20. At speeds above normal subcavitating speeds, when it is desirable to have dualcavitating hydrofoil 10 generate cavity 50 over at least a portion of upper surface 20, circulation control means 46 is shut off.

Design parameters associated with the design of circulation control means 46 include the height of blowing slot 70, the location of blowing slot 70, the radius of trailing edge 30, and the blowing flow rate (represented as the momentum coefficient). The determination of these parameters is well known in the art and will not be described in detail herein. Preferably, blowing slot 70 is located at a point immediately upstream of the initial separation point (point where flow would separate from upper surface 20 if circulation control means 46 were not employed to prevent separation during normal subcavitating operation) and is positioned between the separation point and upper junction 38. Thus, blowing slot 70 is positioned within aft upper segment 36. The location of this separation point is determined at a predetermined subcavitating speed and subcavitating design angle of attack during normal subcavitating operation. Methods of determining flow separation are well known in the art and will not be discussed in detail herein. Briefly, the pressure distribution along hydrofoil 10 can be determined using potential flow theory. Based on the pressure distribution, boundary layer viscous flow theory calculations may be performed to determine boundary layer profiles and the location of flow separation. Normally, the separation point is located at or near the initiation point of the adverse pressure gradient over upper surface 20. Flow exits from blowing slot 70 tangential to upper surface 20 and is directed aft or downstream. Height of blowing slot 70 is based on optimum lift augmentation. Jet flap 60, circular arc 62 and elliptical arc 64 produce favorable trailing edge profiles for realizing Coanda flow. The size of pump means 74 is based on desired flow rate and the differential pressure between the static pressure at hydrofoil operating depth and the gage pressure of plenum 75. The determination of these parameters is discussed in: Englar, Robert J. and Robert M. Williams, "Design of a Circulation Control Stern Plane for Submarine Applications," Naval Ship Research and Development Center Report ASED-200 (March 1971), herein incorporated by reference.

When high lift coefficients for lift augmentation are desired of circulation control means 46, suction pressure peaks may occur at leading edge 28. To avoid leading edge pressure peaks, a rounded leading edge profile, as discussed above, may be employed.

Figure 3:
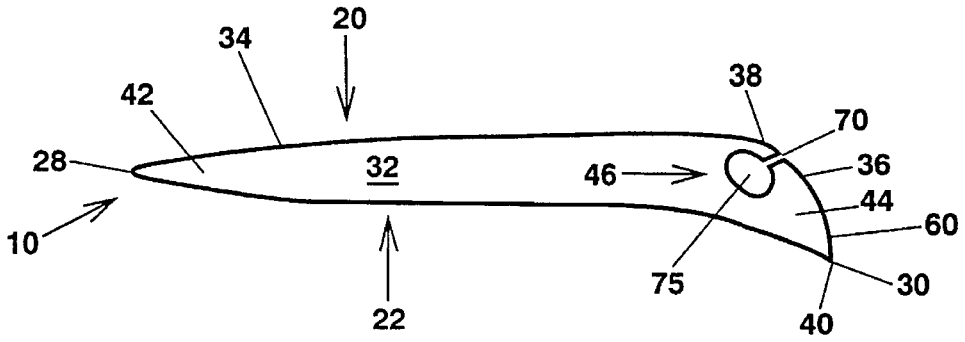
FIG. 3 shows a cross-sectional profile of one embodiment of the present invention.
Figure 4A:
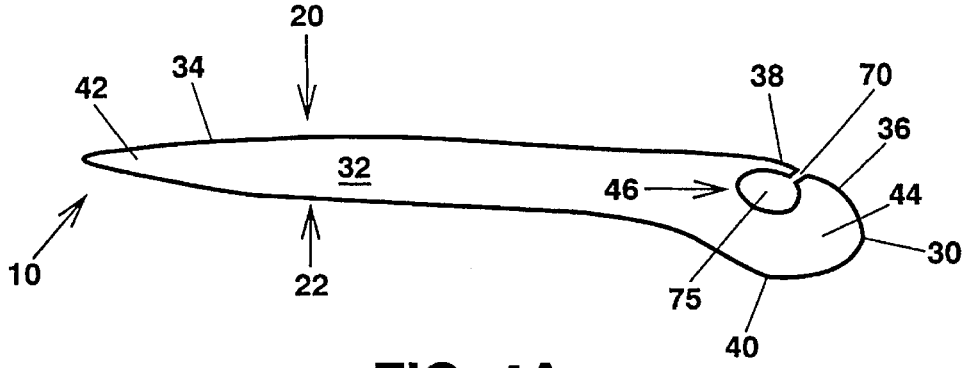
FIGS. 4A and 4B show a second embodiment of the present invention under normal subcavitating operation and normal supercavitating operation, respectively.
Figure 4B:
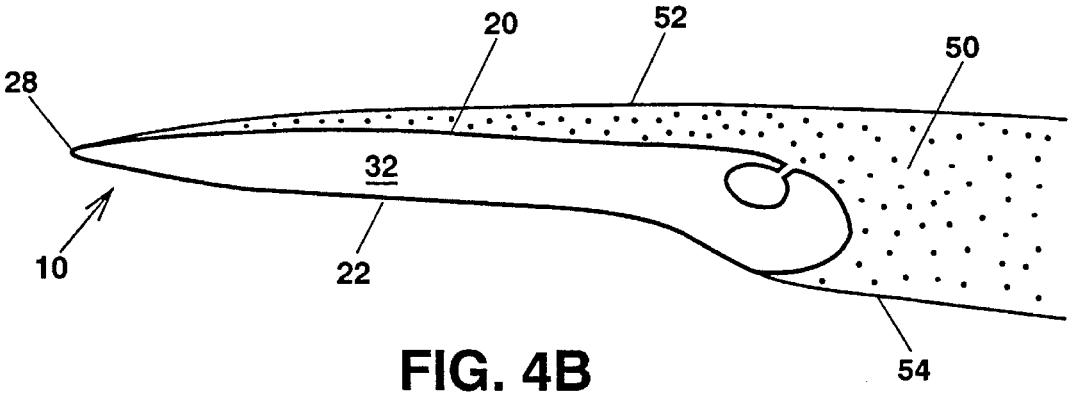
Figure 5:
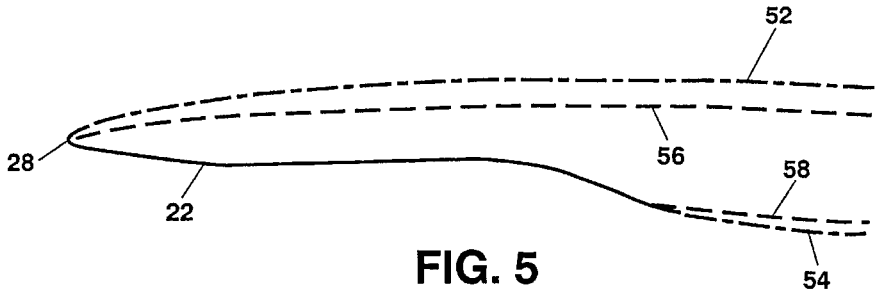
FIG. 5 shows the upper and lower cavity streamlines at $\alpha$ and $(\alpha-x\Delta\alpha)$ for an exemplary embodiment of the present invention.

In one preferred embodiment, as shown in FIGS. 3–5, dualcavitating hydrofoil 10 overcomes cavitation problems associated with high speed operation of prior art subcavitating hydrofoil structures by providing lower surface 22 having a supercavitating profile shape to achieve a supercavitating condition at high speeds. Generally, the shape of lower surface 22 is tailored to the specific operating range of marine vehicle 12. That is, if marine vehicle 12 will be spending most of its time at subcavitating speeds, the supercavitating profile shape of lower surface 22 will have less camber than if marine vehicle 12 were to spend most of its time at supercavitating speeds. Thus, generally, supercavitating profile camber will increase with increasing time spent in supercavitating operation.

Dualcavitating hydrofoil 10 overcomes problems associated with low speed operation of prior art supercavitating hydrofoil structures by providing upper surface 20 having aft upper segment 36 adapted to form curved aft section 44 and boundary layer circulation control means 46 to suppress flow separation during normal subcavitating operation. As a result, when used as a lifting surface on marine vehicle 12, dualcavitating hydrofoil 10 provides a structure capable of efficiently achieving take-off and foilborne operation in a subcavitating mode with circulation control means 46 operating and, with circulation control means 46 disengaged, switching to a supercavitating mode for efficient high speed operation.

Upper surface 20 is shaped and constructed to efficiently produce substantially all of the predetermined required lift force during normal subcavitating operation by generating a low pressure region over upper surface 20. During normal subcavitating operation, both upper and lower surfaces, 20 and 22, are substantially fully wetted. Lower surface 22 is shaped and constructed to efficiently produce substantially all of the predetermined required lift force during normal supercavitating operation by generating a high pressure region over lower surface 22. During normal supercavitating operation, lower surface 22 functions to generate air or vapor filled cavity 50 extending aft from leading edge 28 such that upper surface 20 is completely enveloped within cavity 50 and lower surface 22 is at least partially wetted.

The shape of cavity 50 is defined by the cavity streamline which corresponds to the outer edge of cavity 50, i.e., the interface between cavity 50 and the surrounding water. FIG. 5 shows supercavitating lower surface 22 and the cavity streamlines generated by lower surface 22 during normal supercavitating operation. Upper streamline 52 and lower streamline 54 are generated at angle of attack $\alpha$. Upper streamline 56 and lower streamline 58 are generated at angle of attack $(\alpha - x\Delta\alpha)$. Using well known supercavitating theory, the shape and extent of cavity 50 as defined by the cavity streamlines can be determined for any particular supercavitating profile shape (i.e., any particular shape of lower surface 22), speed, hydrofoil depth, and angle of attack.

In this embodiment of dualcavitating hydrofoil 10, lower surface 22 constitutes a supercavitating profile wherein during normal supercavitating operation, as illustrated in FIG. 4B, lower surface 22 functions to generate cavity 50 extending aft from leading edge 28 such that upper surface 20 is completely enveloped within cavity 50. The supercavitating profile of lower surface 22 comprises a concave contour (all of lower surface 22 being concave) or convex-concave contour (a forward portion of lower surface 22 being convex and an aft portion of lower surface 22 being concave) that results in increased pressure over lower surface 22 and produces cavity 50 at supercavitating speeds. The supercavitating profile of lower surface 22 may be, for example, a circular arc, a 2-term supercavitating section, a 3-term supercavitating section, or a 5-term supercavitating section (examples of which are shown in FIG. 5. of co-owned and copending application Ser. No. 08/414,836).

The contour of forward upper segment 34, from leading edge 28 to upper junction 38, corresponds to cavity streamline 56 determined at the predetermined design speed and at an angle of $(\alpha_{SUPER} - x\Delta\alpha_{SUPER})$ where $\alpha_{SUPER}$ the supercavitating design angle of attack of dualcavitating hydrofoil 10, $\Delta\alpha_{SUPER}$ is the predetermined operational variation of the design angle of attack experienced by dualcavitating hydrofoil 10 during normal supercavitating operation, and x is an operational parameter that may be varied by the designer based on his or her experience and knowledge of the intended operational environment. The parameter x reflects the degree of tolerance for upper surface 20 to experience occasional contact with water during normal supercavitating operation in waves. Preferable x is between 1.0 and 1.4. Once the craft weight and the required hydrofoil lift is known, using well known supercavitating theory, the supercavitating profile of lower surface 22 is determined to provide the required lift at the supercavitating design speed and design angle of attack. When operating in a normal supercavitating mode, supercavitating lower surface 22 will produce cavity 50 at any particular speed and angle of attack irrespective of upper surface 20. Once the supercavitating profile of lower surface 22 is specified, the shape of cavity 50 and cavity streamlines, 52, 54, 56 and 58, at the design speed and design cavitation number are specified. As a result, the shape of forward upper segment 34 is defined.

Figure 7:
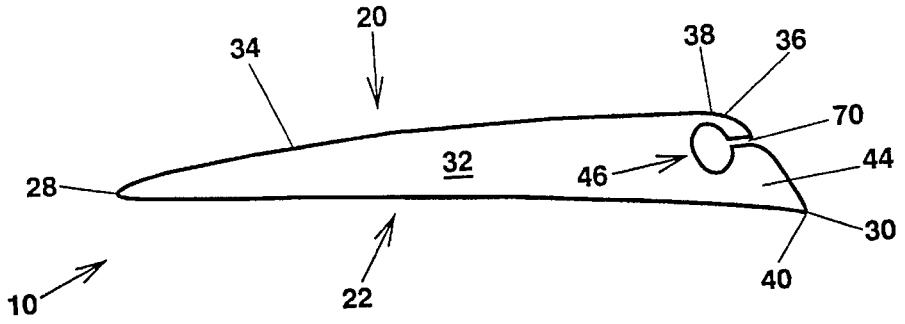
FIG. 7 shows a cross-sectional profile of a third embodiment of the present invention.
Figure 8A:
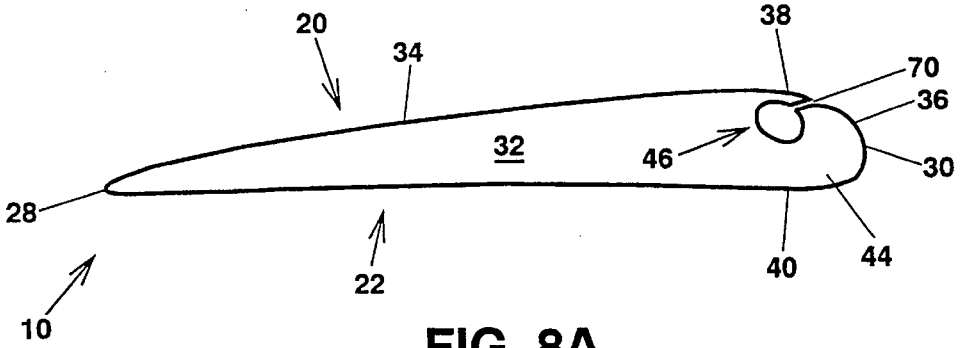
FIGS. 8A and 8B show a fourth embodiment of the present invention under normal subcavitating operation and under normal basecavitating operation, respectively.
Figure 8B:
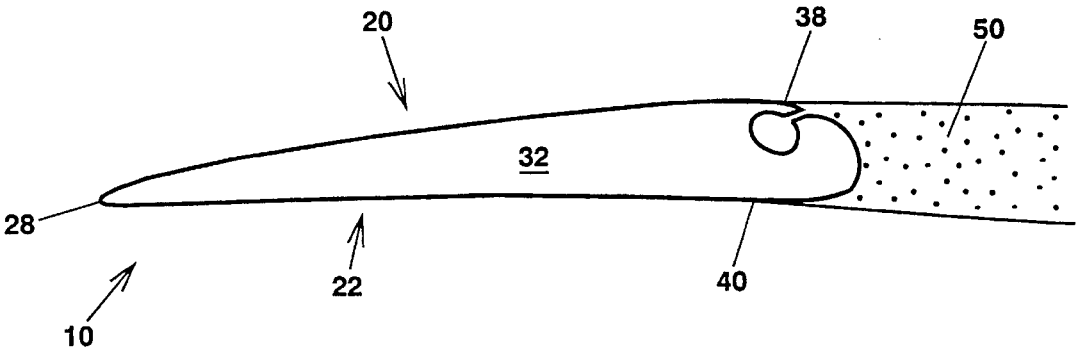

In an alternative embodiment, as depicted in FIGS. 7 and 8, dualcavitating hydrofoil 10 overcomes cavitation problems associated with high speed operation of prior art subcavitating hydrofoil structures by providing a basecavitating profile shape to achieve a basecavitating condition at high speeds. Dualcavitating hydrofoil 10 overcomes problems associated with low speed operation of prior art basecavitating and base ventilated hydrofoil structures by providing upper surface 20 having aft upper segment 36 adapted to form curved aft section 44 and boundary layer circulation control means 46 that employs the Coanda effect to achieve a smooth flow exit at trailing edge 30 to suppress flow separation for efficient, low drag, high lift subcavitating operation compared to prior art blunt based hydrofoils. As a result, when used as a lifting surface on marine vehicle 12, dualcavitating hydrofoil 10 provides a structure capable of efficiently achieving take-off and foilborne operation in a subcavitating mode (below about 45 knots) with circulation control means 46 operating and, with circulation control means 46 disengaged, switching to a basecavitating mode for efficient high speed operation (between about 45 and 60 knots).

Upper surface 20 is adapted to efficiently produce a lift force sufficient to lift marine vehicle 12 above water surface 16 during normal subcavitating operation at subcavitating speeds wherein upper and lower surfaces, 20 and 22, are substantially fully wetted. Upper and lower surfaces, 20 and 22, are adapted to efficiently produce a lift force sufficient to maintain marine vehicle 12 above water surface 16 at speeds above the normal subcavitating speeds wherein upper and lower surfaces, 20 and 22, are substantially fully wetted forward of about upper and lower junctions, 38 and 40, and aft upper section 36 is completely enveloped within cavity 50 initiating from about upper and lower junctions, 38 and 40.

In accordance with this embodiment, dualcavitating hydrofoil 10 comprises upper surface 20, lower surface 22, leading edge 28 formed by a forward intersection of upper and lower surfaces, 20 and 22, and trailing edge 30. Upper surface 20 is divided into forward upper segment 34 extending aft from the leading edge 28, aft upper segment 36, and upper junction 38 therebetween. Forward upper segment 34 joins aft upper segment 36 at upper junction 38. Lower surface 22 joins aft upper segment 36 at lower junction 40. Upper and lower surfaces, 20 and 22, define profile 32 of dualcavitating hydrofoil 10. Forward of a plane connecting upper and lower junctions, 38 and 40, profile 32 is tapered to a thin leading edge while aft of this plane profile 32 has a curved aft section 44 that is thick when compared to thin leading edge 28. Dualcavitating hydrofoil 10 further includes boundary layer circulation control means 46 for generating a flow over aft upper segment 36 such that boundary layer separation over upper surface 20 is avoided during normal subcavitating operation.

Additionally, an air venting system for emitting air through vents located at or near trailing edge 30 and into cavity 50 behind trailing edge 30 may be incorporated to initiate a base ventilated condition. Systems for venting gas from a surface into a flow, comprising among other things an air or gas source, pipes or tubes for transporting the gas from the source to the vent, one or more vents in the surface, and a control system for regulating the gas flow, are well known in the art and will not be described in detail here.

A series of basecavitating hydrofoils was developed in the 1960's for high speed application. Basecavitating hydrofoils are, basically, airfoils with the thin trailing edge cut-off to form a blunt trailing edge (base). The blunt trailing edge enabling basecavitating hydrofoils to operate without cavitation at speeds about 30% higher than subcavitating hydrofoils with thin trailing edges. However, a cavity or wake is formed behind the blunt trailing edge resulting in reduced efficiency at subcavitating speeds compared to subcavitating hydrofoils. Air may be vented into the cavity to reduce drag but low speed efficiency is still very poor. In fact, the cavity drag can be so high and take off requires such a large prime mover, that the use of basecavitating or base ventilated hydrofoils below about 45 knots is undesirable.

Dualcavitating hydrofoil 10 suppresses the cavity drag at take off and at cruising speeds of about 30 to 45 knots. Dualcavitating hydrofoil 10 operates in a subcavitating mode at take off and between about 30 to 45 knots and in a basecavitating or base ventilated mode at speeds of about 45 to 60 knots. The basic design of this embodiment of dualcavitating hydrofoil 10 begins with choosing a blunt based profile for efficient high speed operation using the well known theory originated by Lang and reported in: Lang, T. G., "Base-Vented Hydrofoils, " U.S. Naval Ordnance Test Station Report 6606 (October 1959), herein incorporated by reference. The profile is selected for minimum cavity or wake drag for efficient high speed operation (about 45 to 60 knots). The camber is determined from the required lift coefficient at the design speed. At take off and cruising speeds of about 30 to 45 knots, the cavity drag is suppressed by incorporating jet flap 60 or a bluff body such as circular arc 62 or elliptical arc 64 to form curved aft section 44 in combination with boundary layer circulation control means 46.

The advantages of the present invention are numerous. As stated previously, due to the need to satisfy pressure recovery requirements at the aft portion of a hydrofoil, the aft upper and aft lower segments converge to a point at the trailing edge resulting in a thin trailing edge. The presence of a thin trailing edge may require the use of exotic materials to satisfy the strength requirements to provided structural integrity at the trailing edge. By increasing the trailing edge thickness and incorporating circulation control means for generating a Coanda flow over the trailing edge, the present invention overcomes the need for such materials.

The present dualcavitating hydrofoil operates efficiently over a wider speed range and produces a higher average efficiency (lift-to-drag ratio) over that speed range than prior art hydrofoils. The dualcavitating hydrofoil provides the predetermined lift force required for foilborne operation during normal subcavitating operation at subcavitating speeds of below about 45 knots, during basecavitating operation between about 45 and 60 knots, and during normal supercavitating operation at supercavitating speeds of above about 50 knots. The dualcavitating hydrofoil accomplishes this while enhancing structural integrity compared to prior art thin trailing edge hydrofoils. The dualcavitating hydrofoil improves seakeeping quality of the hydrofoil craft in waves at intermediate speeds (between about 30 and 45 knots) by employing circulation control through the Coanda effect without the resorting to expensive and complicated incidence control or flap control. The dualcavitating hydrofoil has high efficiency (lift-to-drag ratio) at subcavitating speeds when compared to prior art basecavitating, base ventilated or supercavitating designs. The dualcavitating hydrofoil provides operation free from the detrimental effects of cavitation over a wide speed range. The dual cavitating hydrofoil overcomes problems associated with cavitation at high speeds by unwetting the upper surface. A hydrofoil may be tailored to a specific design speed and operating environment while producing higher efficiency at off-design speeds than either basecavitating, base ventilated or supercavitating hydrofoils. The dualcavitating hydrofoil produces higher low speed efficiency and is less sensitive to variations in angle of attack than either basecavitating, base ventilated or supercavitating hydrofoils. The dualcavitating hydrofoil is capable of providing efficient operation in a subcavitating mode at speeds below about 45 knots, in a basecavitating (or base ventilated) mode at speeds between about 45 and 60 knots, and in a supercavitating mode at speeds above about 50 knots in order to provide a hydrofoil for use over a wide speed range and in both low and high sea states. The dualcavitating hydrofoil is capable of efficiently achieving take-off speed, and of operating efficiently at high speeds.

The present invention and many of its attendant advantages will be understood from the foregoing description and it will be apparent to those skilled in the art to which the invention relates that various modifications may be made in the form, construction and arrangement of the elements of the invention described herein without departing from the spirit and scope of the invention or sacrificing all of its material advantages. The forms of the present invention herein described are not intended to be limiting but are merely preferred or exemplary embodiments thereof.

What is claimed is:

1. A dualcavitating hydrofoil for providing dynamic lift to a marine vehicle, comprising:

an upper surface having an aft upper segment;

a lower surface wherein said upper and lower surfaces define a profile of said dualcavitating hydrofoil; and boundary layer circulation control means for generating a flow over said aft upper segment such that boundary layer separation over said upper surface is avoided during normal subcavitating operation;

wherein said upper and lower surfaces function to provide a lift force sufficient to lift the marine vehicle above a water surface, said upper surface being adapted to efficiently produce said lift force during normal subcavitating operation at subcavitating speeds wherein said upper and lower surfaces are substantially fully wetted, and said profile being adapted to efficiently produce said lift force above normal subcavitating speeds wherein at least a portion of said upper surface is enveloped within a cavity generated by said profile and substantially all of said lower surface is wetted.

2. A dualcavitating hydrofoil as in claim 1, further comprising:

a leading edge formed by a forward intersection of said upper and lower surfaces; and a trailing edge;

said upper surface being divided into a forward upper segment and said aft upper segment and having an upper junction therebetween, said forward upper segment extending aft from said leading edge, said forward upper segment joining said aft upper segment at said upper junction, said lower surface joining said aft upper segment at a lower junction; and wherein said profile has a tapered section adjacent said leading edge and a thick curved section adjacent said trailing edge.

3. A dualcavitating hydrofoil as in claim 2, wherein:

said lower surface constitutes a supercavitating profile whereby during normal supercavitating operation said lower surface functions to generate said cavity, said cavity extending aft from said leading edge such that said upper surface is completely enveloped within said cavity and substantially all of said lower surface is wetted, said cavity having a cavity streamline defined by an outer edge of said cavity;

a contour of said forward upper segment corresponds to said cavity streamline determined at a predetermined design speed during normal supercavitating operation and an angle of $(\alpha - x\Delta\alpha)$ where e is a design angle of attack of said dualcavitating hydrofoil during normal supercavitating operation, $\Delta\alpha$ is a predetermined operational variation of said design angle of attack experienced by said dualcavitating hydrofoil during normal supercavitating operation, and x is a parameter between 1.0 and 1.4;

a contour of said aft upper segment is adapted to provide said thick curved section; and said boundary layer circulation control means is positioned to generate a Coanda flow over said thick curved section.

4. A dualcavitating hydrofoil as in claim 3, wherein said supercavitating profile is selected from the group consisting of a circular arc, a 2-term supercavitating section, a 3-term supercavitating section, and a 5-term supercavitating section.

5. A dualcavitating hydrofoil as in claim 2, wherein said upper junction is located at a point just upstream of a separation point determined at a predetermined subcavitating speed and subcavitating design angle of attack during normal subcavitating operation.

6. A dualcavitating hydrofoil as in claim 2, wherein said contour of said aft upper segment comprises a jet flap wherein said trailing edge is formed by an aft intersection of said upper and lower surfaces.

7. A dualcavitating hydrofoil as in claim 2, wherein said contour of said aft upper segment is selected from the group consisting of a circular arc and an elliptical arc, wherein said trailing edge is formed by said aft upper segment and further wherein said lower junction is forward of said trailing edge and is approximately aligned with said upper junction.

8. A dualcavitating hydrofoil as in claim 2, wherein said circulation control means comprises:

a blowing slot in said upper surface located immediately upstream of a separation point at a point between said separation point and said upper junction, said separation point determined at a predetermined subcavitating speed and subcavitating design angle of attack during normal subcavitating operation, said slot functioning to eject said flow tangentially to said aft upper segment;

and means for delivering said flow to said blowing slot.

9. A dualcavitating hydrofoil as in claim 2, wherein:

said profile of said dualcavitating hydrofoil is tapered from about said upper and lower junctions to said leading edge and has a thick curved section from about said upper and lower junctions to said trailing edge; and said upper and lower surfaces are adapted to efficiently produce said lift force above normal subcavitating speeds whereby said upper and lower surfaces are substantially fully wetted forward of about said upper and lower junctions and said aft upper section is completely enveloped within a cavity generated at about said upper and lower junctions.

10. A dualcavitating hydrofoil for providing dynamic lift to a marine vehicle, comprising:

an upper surface being divided into a forward upper segment and an aft upper segment and having an upper junction therebetween, said forward upper segment extending aft from said leading edge, said forward upper segment joining said aft upper segment at said upper junction;

a lower surface, said lower surface joining said aft upper segment at a lower junction;

a leading edge formed by a forward intersection of said upper and lower surfaces;

a trailing edge;

said upper and lower surfaces defining a profile of said dualcavitating hydrofoil, said profile having a tapered section adjacent said leading edge and a thick curved section adjacent said trailing edge; and boundary layer circulation control means for generating a flow over said aft upper segment such that boundary layer separation over said upper surface is avoided during normal subcavitating operation;

wherein said upper and lower surfaces function to provide a lift force sufficient to lift the marine vehicle above a water surface, said upper surface being adapted to efficiently produce said lift force during normal subcavitating operation at subcavitating speeds wherein said upper and lower surfaces are substantially fully wetted, and said lower surface being adapted to efficiently produce said lift force during normal supercavitating operation at supercavitating speeds wherein said upper surface is completely enveloped within a cavity generated by said lower surface and substantially all of said lower surface is wetted.

11. A dualcavitating hydrofoil as in claim 10, wherein:

said lower surface constitutes a supercavitating profile whereby during normal supercavitating operation said lower surface functions to generate said cavity extending aft from said leading edge such that said upper surface is completely enveloped within said cavity, said cavity having a cavity streamline defined by an outer edge of said cavity;

a contour of said forward upper segment corresponds to said cavity streamline determined at a predetermined design speed during normal supercavitating operation and an angle of $(\alpha - x\Delta\alpha)$ where $\alpha$ is a design angle of attack of said dualcavitating hydrofoil during normal supercavitating operation, $\Delta\alpha$ is a predetermined operational variation of said design angle of attack experienced by said dualcavitating hydrofoil during normal supercavitating operation, and x is a parameter between 1.0 and 1.4;

a contour of said aft upper segment is adapted to provide said thick curved section; and said boundary layer circulation control means is positioned to generate a Coanda flow over said thick curved section.

12. A dualcavitating hydrofoil as in claim 11, wherein said upper junction is located at a point just upstream of a separation point, said separation point determined at a predetermined subcavitating speed and subcavitating design angle of attack during normal subcavitating operation.

13. A dualcavitating hydrofoil as in claim 12, wherein said contour of said aft upper segment comprises a jet flap wherein said trailing edge is formed by an aft intersection of said upper and lower surfaces.

14. A dualcavitating hydrofoil as in claim 12, wherein said contour of said aft upper segment is selected from the group consisting of a circular arc and an elliptical arc wherein said trailing edge is formed by said aft upper segment and further wherein said lower junction is forward of said trailing edge and said lower junction is approximately aligned with said upper junction.

15. A dualcavitating hydrofoil as in claim 12, wherein said circulation control means comprises:

a blowing slot in said upper surface located at a point immediately upstream of said separation point between said separation point and said upper junction, said slot functioning to eject said flow tangentially to said aft upper segment;

and means for delivering said flow to said blowing slot.

16. A dualcavitating hydrofoil for providing dynamic lift to a marine vehicle, comprising:

an upper surface, said upper surface being divided into a forward upper segment and an aft upper segment and having an upper junction therebetween, said forward upper segment extending aft from said leading edge, said forward upper segment joining said aft upper segment at said upper junction;

a lower surface, said lower surface joining said aft upper segment at a lower junction;

a leading edge formed by a forward intersection of said upper and lower surfaces;

a trailing edge;

said upper and lower surfaces defining a profile of said dualcavitating hydrofoil, said profile being tapered from about said upper and lower junctions to said leading edge and having a thick curved section from about said upper and lower junctions to said trailing edge; and boundary layer circulation control means for generating a flow over said aft upper segment such that boundary layer separation over said upper surface is avoided during normal subcavitating operation;

wherein said upper and lower surfaces function to provide a lift force sufficient to lift the marine vehicle above a water surface, said upper surface being adapted to efficiently produce said lift force during normal subcavitating operation at subcavitating speeds wherein said upper and lower surfaces are substantially fully wetted, and said upper and lower surfaces being adapted to efficiently produce said lift force above normal subcavitating speeds whereby said upper and lower surfaces are substantially fully wetted forward of about said upper and lower junctions and said aft upper section is completely enveloped within a cavity generated at about said upper and lower junctions.

17. A dualcavitating hydrofoil as in claim 16, wherein said upper junction is located at a point just upstream of a separation point determined at a predetermined subcavitating speed and subcavitating design angle of attack during normal subcavitating operation.

18. A dualcavitating hydrofoil as in claim 16, wherein said contour of said aft upper segment comprises a jet flap wherein said trailing edge is formed by an aft intersection of said upper and lower surfaces.

19. A dualcavitating hydrofoil as in claim 16, wherein said contour of said aft upper segment is selected from the group consisting of a circular arc and an elliptical arc, wherein said trailing edge is formed by said aft upper segment and further wherein said lower junction is longitudinally forward of said trailing edge.

20. A dualcavitating hydrofoil as in claim 16, wherein said circulation control means comprises:

a blowing slot in said upper surface immediately upstream of a separation point, said blowing slot located at a point between said separation point and said upper junction, said separation point determined at a predetermined subcavitating speed and subcavitating design angle of attack during normal subcavitating operation, said slot functioning to eject said flow tangentially to said aft upper segment to generate a Coanda flow over said aft upper segment;

and means for delivering said flow to said blowing slot.

* * * * *